US011400567B2

(12) United States Patent
Langhorst

(10) Patent No.: US 11,400,567 B2
(45) Date of Patent: Aug. 2, 2022

(54) SCREW DEVICE AND HAND-HELD SCREW SYSTEM

(71) Applicant: Johannes Lübbering GmbH, Herzebrock-Clarholz (DE)

(72) Inventor: Thomas Langhorst, Harsewinkel-Greffen (DE)

(73) Assignee: Johannes Lübbering GmbH, Herzebrock-Clarholz (DE)

( * ) Notice: Subject to any disclaimer, the term of this patent is extended or adjusted under 35 U.S.C. 154(b) by 465 days.

(21) Appl. No.: 16/604,197

(22) PCT Filed: Jan. 31, 2018

(86) PCT No.: PCT/EP2018/052395

§ 371 (c)(1),
(2) Date: Oct. 10, 2019

(87) PCT Pub. No.: WO2018/188829

PCT Pub. Date: Oct. 18, 2018

(65) Prior Publication Data

US 2020/0061780 A1 Feb. 27, 2020

(30) Foreign Application Priority Data

Apr. 13, 2017 (EP) ..... 17166609

(51) Int. Cl.
*B25B 17/00* (2006.01)
*B25B 13/48* (2006.01)
(Continued)

(52) U.S. Cl.
CPC ..... *B25B 17/00* (2013.01); *B25B 13/481* (2013.01); *B25B 21/00* (2013.01); *B25B 23/1425* (2013.01)

(58) Field of Classification Search
CPC ..... B25B 17/00; B25B 21/00; B25B 13/481; B25B 23/1425
See application file for complete search history.

(56) References Cited

U.S. PATENT DOCUMENTS 3,035,451 A 5/1962 O'Connell et al.
5,355,751 A 10/1994 Specht
(Continued)

FOREIGN PATENT DOCUMENTS

EP 0164574 A2 12/1985
EP 0180915 A1 5/1986
(Continued)

OTHER PUBLICATIONS

International search report for patent application No. PCT/EP2018/052395 dated Apr. 11, 2018.

*Primary Examiner* — David B. Thomas
(74) *Attorney, Agent, or Firm* — Bachman & LaPointe, P.C.

(57) ABSTRACT

The invention relates to a screw device for applying torque to a screw partner (12), comprising flat output assembly (10) provided with an output member that can be detachably connected to the screw partner and a drive to which a drive torque can be manually or mechanically applied, particularly by an interconnected angular and/or bevel gear (16), and an assembly (48) for detecting an output torque acting on the screw partner on the output side, the detection assembly associated with the flat output assembly and particularly provided on and/or in a housing (30 32) of the flat output assembly being designed such that it can detect an axial force acting on a helical gear (38) connecting the drive and the output member of the flat output assembly in a torque-transmitting manner and provide same for preferably electronic signal evaluation.

20 Claims, 3 Drawing Sheets

(51) Int. Cl.
*B25B 21/00* (2006.01)
*B25B 23/142* (2006.01)

(56) References Cited

U.S. PATENT DOCUMENTS

| | | | | |
|---|---|---|---|---|
| 2004/0237729 | A1 | 12/2004 | Berman | |
| 2010/0269646 | A1 | 10/2010 | Le Du et al. | |
| 2015/0114675 | A1* | 4/2015 | Kraus | B23B 45/008 173/178 |

FOREIGN PATENT DOCUMENTS

| | | | |
|---|---|---|---|
| GB | 2383282 | A | 6/2003 |
| GB | 2429420 | A | 2/2007 |
| JP | 5817328 | A | 2/1983 |
| JP | 61117005 | A | 6/1986 |
| JP | 2001124153 | A | 5/2001 |
| SU | 1077777 | A1 | 3/1984 |
| SU | 1260180 | A1 | 9/1986 |
| WO | 2007063106 | A1 | 6/2007 |

* cited by examiner

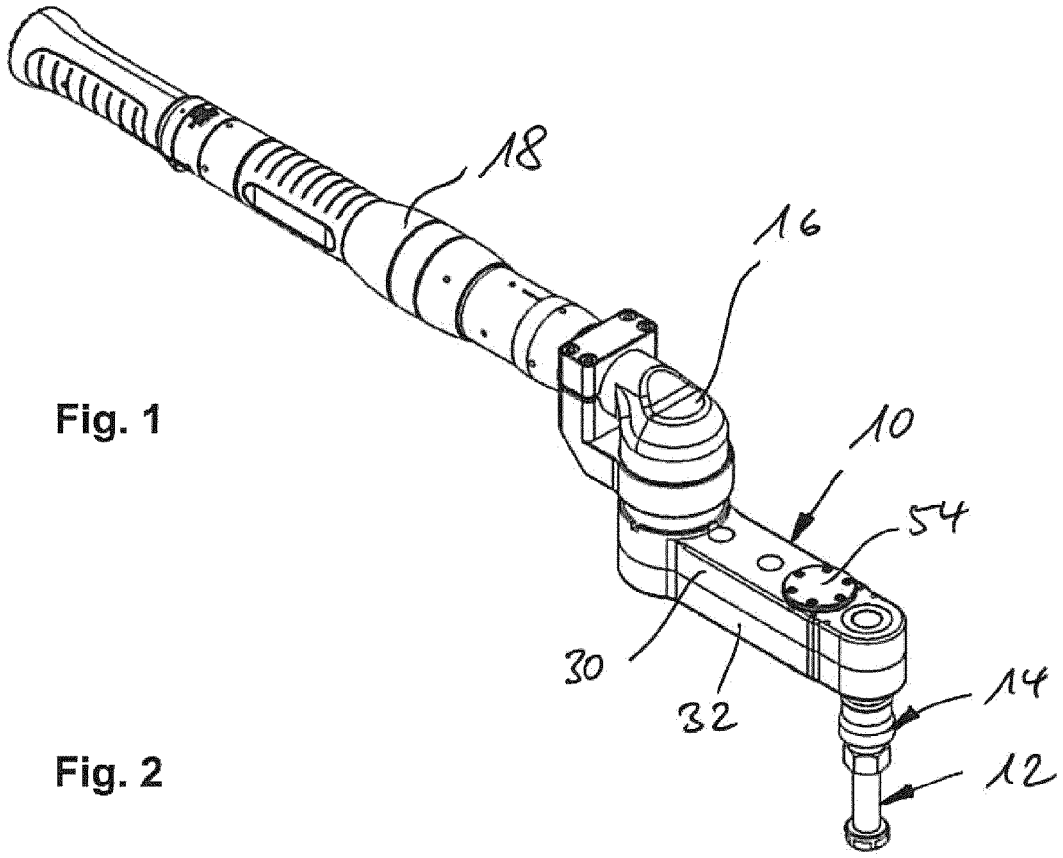
Fig. 1
Fig. 2
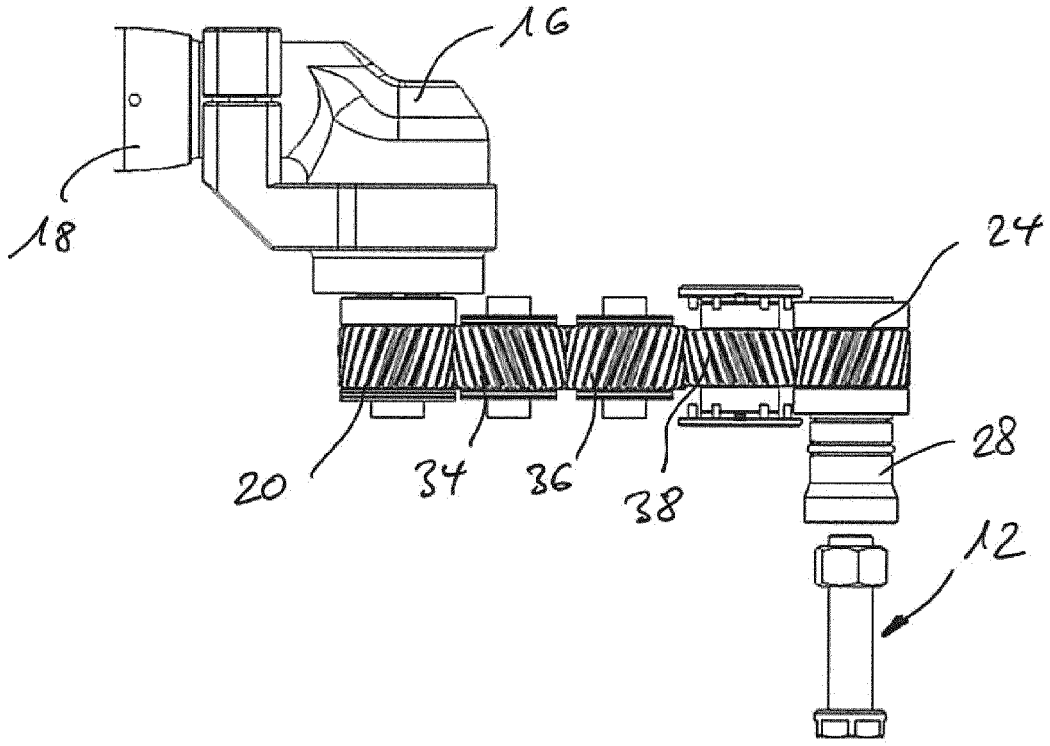

SCREW DEVICE AND HAND-HELD SCREW SYSTEM

BACKGROUND OF THE INVENTION

The present invention relates to a screwing device for applying a torque to a screwing partner. Additionally, the present invention relates to a handheld screwing system having such a generic screwing device.

From the state of the art, in particular the industrial screwing technology, screwing devices in the manner of the preamble are generally known. In particular during the screwing or assembly when the screwing partner (i.e., for example, a screw to be applied with a torque within scope of the context of the present invention) is difficult to access due to particular spatial installation conditions, so-called flat outputs are often used. The flat outputs are gear assemblies—usually accommodated in a flat housing—normally having a drive provided at one end and an opposite output at the other end at which the screwing partner can be detachably attached. The gear in the flat output housing is often an assembly of gear wheels meshing with one another and thus realizing a torque transmission from the drive to the output, said gear realizing a 1:1 transmission between the drive and the output (which are often provided as gear wheels with a corresponding external gearing), but, depending on the area of application, different variations and modifications of the technology to be understood as generally known and generic being possible and known.

If the driving torque provided for the screwing is applied to the flat output at the driving side, as generically provided, either manually or mechanically—the application may also take place via an angle head realizing an angle or bevel gearing, for example for producing an elongated and flat total assembly—there is a possibility to actuate screwing partners which are difficult to access in a reliable manner with little clearance and having a good mechanical efficiency, for example when using high-quality flat output means.

In the industrial context, however, it is often required to detect a specific screwing or driving torque to be applied to the screwing partner for reasons of quality control or documentation. While screwdrivers or other tools generating a torque to be provided at the driving side of the flat output means often have torque detecting means (such as a conventional torque wrench in the simplest case), such a torque detection, which is connected upstream of the drive of the flat output, is potentially problematic and insufficient, in particular with respect to an accuracy of the detection of a torque specifically applied to the screwing partner (i.e. at the output side of the flat output means). Such a torque measurement to be understood as generally known is not only subject to tolerances and not accurate, but said measurement also includes the entire additional mechanical transmission path to the screwing partner, comprising a torque efficiency of the flat output means and possible torque losses (not negligible as a result of the geometry) of angle heads or similar angle gearings to be interposed, thus increasing measurement errors and measurement tolerances.

As an alternative to the torque detection at the driving side, it is therefore conceivable to provide a detection of the torque at the output side of the flat output means, for example in the form of a conventional measuring shaft. However, apart from the additional and considerable effort, said alternative is problematic because of the structural or geometrical aspects of a flat output. Since typical generic flat outputs are designed for a structural shape being as small and compact as possible while allowing for a maximum applied torque (the intended use of such flat outputs), the corresponding integration of a conventional torque measuring shaft is difficult or impossible. Furthermore, there are additional requirements in terms of maintenance or circuitry in order to ensure a reliable torque detection at the output side.

SUMMARY OF THE INVENTION

Therefore, the object of the present invention is to improve a screwing device for applying a torque to a screwing partner as disclosed herein, in particular with respect to the measurement accuracy of the detecting means for detecting an output torque applied to the screwing partner at the output side, thereby to avoid, in particular, possible errors and tolerances with respect to the measurement which are caused by the respective gear components, deflection components and connection components, as much as possible and, at the same time, to enable a device which can be produced with little production effort, thus being cost-efficient and reliable, the geometrical compactness of the flat output means being to be maintained without losses with respect to the maximum applied torques, compared to the generic state of the art.

Concerning the screwing device for applying a torque to a screwing partner, the object is attained by the features disclosed herein and; advantageous embodiments of the invention are also disclosed herein and in the dependent claims. Within the scope of the invention, protection is also sought for a handheld screwing system having a screwing device according to the invention and means for generating a driving torque, for example in the form of a screwdriver or a similar device, which are connected to the flat output means.

In an advantageous manner according to the invention, the means for detecting the output torque applying to the screwing partner at the output side are assigned to the flat output means, in particular in such a manner that said means are provided at and/or in a (flat) housing of the flat output means.

Furthermore, the detecting means assigned to the flat output means are configured in such a manner that they detect an axial force acting on a helical gear wheel connecting the drive and the output of the flat output means in a torque-transmitting manner, and can make said axial force available for the preferably electronic signal evaluation. The term of an "axial force" is to be understood in such a manner that the helical gear wheel according to the invention which connects the drive and the output of the flat output means in a torque-transmitting manner is mounted so as to be rotatable about an axis of rotation, the axis of rotation defining the axial direction of the axial force. Concerning the specific mechanical realization of the invention, this means that the helical gear wheel used according to the invention (and therefore the additional gear wheels or gear rings or gearings meshing with the helical gear wheel), which, in addition to a rotational force application to the gear wheel (according to a pure spur gearing), an additional force component acting along the defined axial direction and applying force to the gear wheel is created, said force moving the gear wheel out of a flat, leveled gear wheel assembly between the drive and the output. Said force then acts against the detecting means according to the invention which can cause the frictional engagement with the gear wheel along the axial direction either directly at a gearing edge of the gear wheel or at an appropriate section of a shaft (separate or configured in one piece at the gear wheel) mounting the gear wheel in a rotatable manner.

In an advantageous embodiment according to the invention, it is possible to realize the drive as a gear wheel and therefore as a drive module having a gearing and to configure the output in a corresponding manner (also as a gear wheel or having a gearing), such that the helical gear wheel interacting with the detecting means according to the invention—by means of additional meshing or interconnected gear wheels, if required—realizes the torque transmission from the drive to the output. Alternatively and thus included in the invention, it is conceivable to configure a gear wheel realizing the output module as a helical gear wheel according to the invention in order to interact with the detecting means.

An important advantage according to the invention can be realized by both options: the torque detection according to the invention by the detecting means as closely as possible at the output side of the flat output means either directly by a corresponding configuration of an output module (output gear wheel) for interacting with the detecting means, or, more preferably, by an interaction of a (meshing) gear wheel directly interacting with the output module as a helical gear wheel according to the invention.

Within the scope of preferred embodiments of the invention and according to the geometrical basic structure of a flat output, the helical gear wheel according to the invention (and thus additional meshing gear wheels) is preferably provided in a housing of the flat output means in such a manner that respective axes of rotation are parallel to one another and extend through parallel flat sides of the flat output. The axis of rotation of the helical gear wheel (and the axes of rotation of the additional gear wheels, more preferably also axes of rotation of the drive module and/or output module) would be perpendicular to a longitudinal extension of the flat output means (or of an elongated housing forming the flat output means). However, this is not mandatory; it is also conceivable, in particular, that the flat output means are configured so as to be angled and/or cranked—in the plane of the flat side(s) or perpendicular thereto. Transmission ratios other than 1:1 are also possible.

With respect to the specific realization of the detecting means, said means are preferably realized as a piezoelectric force sensor or by means of a strain gauges assembly. Such assemblies can be obtained from specialized manufacturers—also in a compact form and having a high measurement accuracy—and can be provided in a structurally simple manner for the axial and force-fitting interaction with the helical gear wheel and they can be simply integrated in a housing of the flat output means.

Alternatively, it is conceivable to absorb the axial force acting on the helical gear wheel, for example by means of a hydraulic transmission in the form of a hydraulic piston realized at or in the gear shaft and to transmit it to another position at or in the flat output means where a hydraulic pressure sensor (structurally simple and cheap, in particular compared to a piezo pressure sensor) can realize the axial force measurement. In both cases, a measuring signal representing the torque at the output side in a reliable manner and with a high degree of measurement accuracy and precision can be generated without any need to provide a rotating component in the form of a measuring shaft, as it is the case for known devices for detecting a torque by means of a measuring shaft.

The structural simplicity of the present invention for generating a signal which can be evaluated electronically allows for a compact and cost-efficient realization of a signal evaluation, an (electronic) interface functionality for a standardized external evaluability and/or an (also preferably wireless) external signal transmission using miniaturized electronic components. The electrical energy supply means for such electronic interface or signal processing means provided within the scope of the invention according to the embodiment, in particular, allows for such a wireless and autonomous functionality to be used flexibly, an electrical generator, apart from a battery for the electrical energy supply means, also being conceivable according to the embodiment, said generator making use of the rotations of the respective components inevitably occurring when using a screwing device according to the invention in an advantageous manner and being able to convert said mechanical kinetic energy into electrical operating energy for the functions which are described above in a manner known per se. The corresponding advantage of an independence from batteries or other wired sources of energy is obvious.

As a result, the generic screwing device using flat output means is realized in such a surprisingly simple and structurally elegant manner that said screwing device provides reliable measured values for determining the output torque acting on a screwing partner at the output side—irrespective of conditions relating to the gear or the mechanical transmission—without any need for extensive and expensive measures. It is thus to be expected that the present invention allows for a reliable detection of measured values of torques at the output side—not only in the context of the industrial assembly and screwing in which an accurate detection and recording of the measured values is already required by constraints in relation to quality and documentation—future applications of the screwing device according to the invention may also be used in a private context or in relation to a hobby.

BRIEF DESCRIPTION OF THE DRAWINGS

Further advantages, features and details of the invention can be derived from the following description of preferred exemplary embodiments and from the drawings.

In the following,

FIG. 1 is a perspective view of the handheld screwing system according to the invention according to a first preferred exemplary embodiment of the invention;

FIG. 2 is a schematic lateral view (housing is removed) of the flat output means according to the invention comprising an upstream angle head;

DETAILED DESCRIPTION

Figure 3:
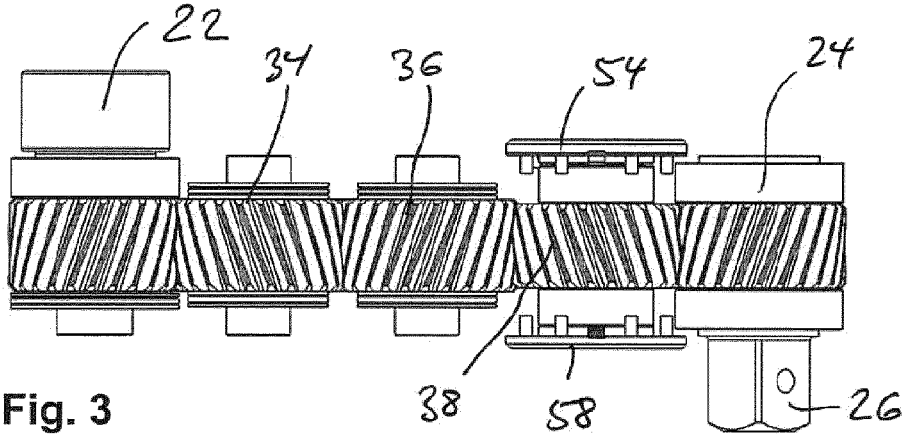
FIG. 3 is a detailed view by analogy with FIG. 2 comprising the assembly of gear wheels realizing the flat output means.

FIG. 1, which is the system and, at the same time, context view for the present invention, shows the perspective view of the screwing device for applying a torque to a screwing partner according to a first exemplary embodiment of the invention comprising flat output means 10 accommodated in a housing 30, 32 which drive a corresponding screwing tool 14 as a screwing partner (not part of the invention) in order to interact with a screw 12 at one end (at the output side). At the driving side, i.e. at the end of the flat output means opposite the output), said flat output means are connected to a screwing tool 18 which can be manually operated via an angle head 16 which comprises a pair of bevel gear wheels; said screwing tool, as a conventional tool which is offered by different tool manufacturers, can apply a torque, which is applied by a motor (e.g. electrically or pneumatically) and which is deflected by a right angle by a module 16, to flat output means 10 which transmit said drive to a tool 28 for the screwing of connecting element 12 in a manner which will be described below.

Figure 4:
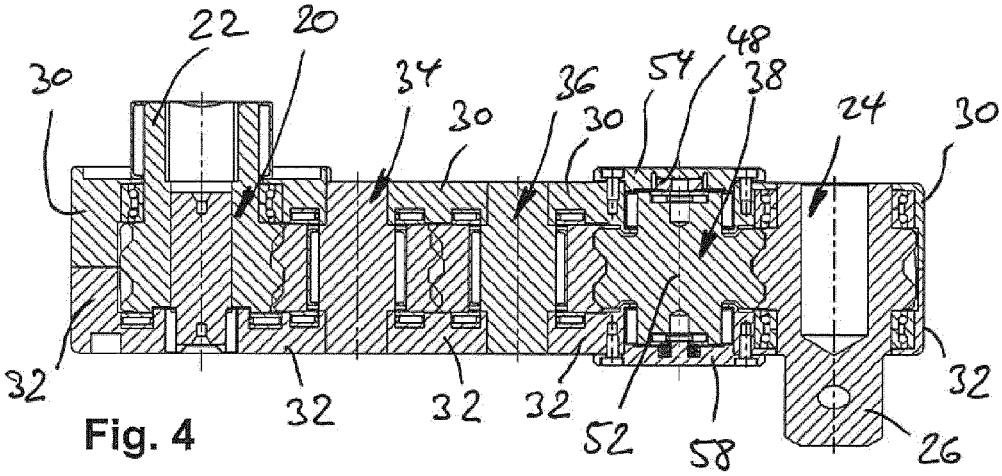
FIG. 4 is a longitudinal sectional view of FIG. 3, also comprising the halves of the housing of the flat output housing enclosing the gear wheels.

The mechanical realization and functionality of the flat output means in the illustrated screwing device can be described, in particular, by the lateral or longitudinal sectional views of FIGS. 2 to 4. It shows that a drive module 20 in the form of a first helical gear wheel is formed at the driving side at the flat output means which is connected to angle head 16 in a torque-transmitting manner (FIG. 2) and to which (FIG. 3, FIG. 4) the driving torque can be applied by a flange section 22 which is configured in one piece.

At the other end (at the output side) of flat output means 10, an output module 24, also in the form of a helical gear wheel, is provided, which can apply the output torque of the flat output means to the screwing partner by means of a square head or tool section 26 (FIG. 3, FIG. 4) and a drive sleeve 28 (FIG. 2) which is connectable thereto in a non-rotatable manner.

A meshing assembly of intermediate helical gear wheels is provided between drive module 20 and output module 24 which are mounted so as to be rotatable and axially parallel to one another in the housing of the flat output means which are formed of housing halves 30, 32 in such a manner that a gear transmission 1:1 is realized between drive module 20 and output module 24; as it is the case for the two modules, intermediate gear wheels 34 to 38 are each axially parallel to one another and disposed in a line-like manner along a longitudinal extension of housing 30, 32 so as to be rotatable in said housing.

According to a typical realization for a manual screwing, such flat output means for transmitting a maximum torque of approx. 200 Nm are provided and adequate; depending on the lubrication conditions and the configuration of the gearings, a normal efficiency of such a helical device is between approx. 80% and 90% (i.e. the ratio of a torque at the output side at 24 in relation to a torque at the driving side at 20).

The lateral or sectional views of FIGS. 2 to 4 show that detecting means are provided at gear wheel 38 which is directly adjacent to output module 24 (and which meshes with the output module), said detecting means detecting an axial force acting on gear wheel 38 (i.e. a force which is generated along the axis of rotation of gear wheel 38 and therefore perpendicular to a longitudinal extension of housing 30, 32—thus extending vertically to the layer of FIGS. 2 to 4—and by the action of the helical gearing which is subject to rotary loading).

Figure 8:
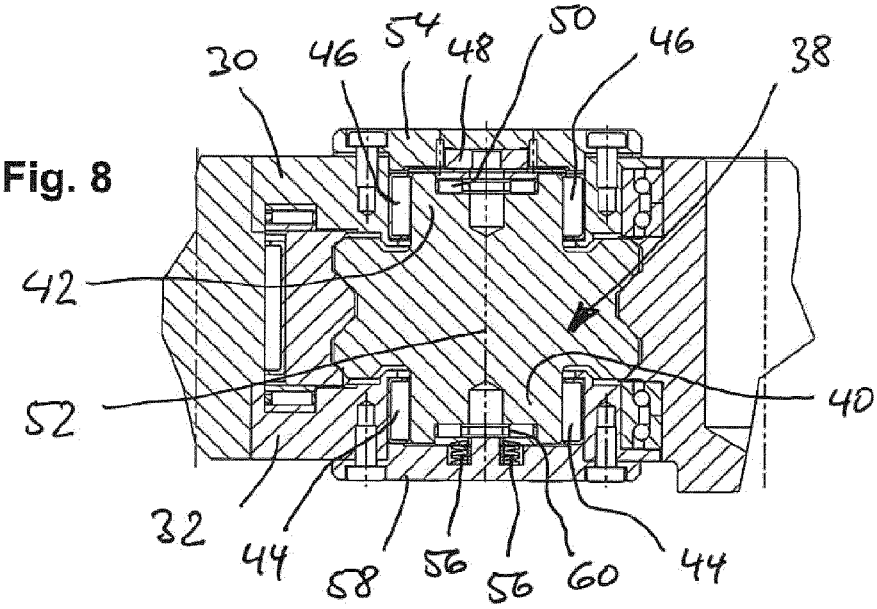
FIG. 7 is a detailed view of the detecting means configured as a pressure or force sensor in the assembled state and FIG. 8 is a detailed sectional view of the helical gear wheel used for detecting the torque in the assembled state of the pressure or force sensor, i.e. a detailed view of FIG. 4.

More specifically and additionally referring to the detailed or exploded views of FIGS. 5 to 8, gear wheel 38 which has shaft sections 40, 42 which are axially configured in one piece at both ends in a contacting manner (and which form pivot bearings for respective housing shells 32 or 30 by means of annular plates 44 or 46) is assigned a force sensor 48 in an axial manner at one end, said force sensor absorbing an axial force of gear wheel 38 by means of a bearing/plate assembly 50 at the sensor side (i.e. in an upward direction along axis 52 in the drawing layer of FIG. 8) and being axially supported by a sensor cover 54 at the other end, said sensor cover being fixed at upper cover shell 30 by means of the illustrated screw connection.

An axial bias (correspondingly transmitted to force sensor 48) is applied to gear wheel 38 via a plain bearing assembly 60 by a compression spring 56 which is supported by a cover module 58 which is screwed to lower cover shell 32. With respect to a desired operating point, sensor 48 which is configured, for example, as a piezo force sensor is biased by a corresponding configuration of compression spring 56. Concerning a specific realization of a torque of approx. 220 Nm to be transmitted by flat output means 10 of the illustrated exemplary embodiment, a force to be absorbed by force sensor 48 can be 3000 N or higher. Typical and conventional force sensors are produced, for example, by Kistler AG (CH-Winterthur), in the illustrated exemplary embodiment type Slimline having a typical maximum outer diameter of 12 mm.

Figure 5:
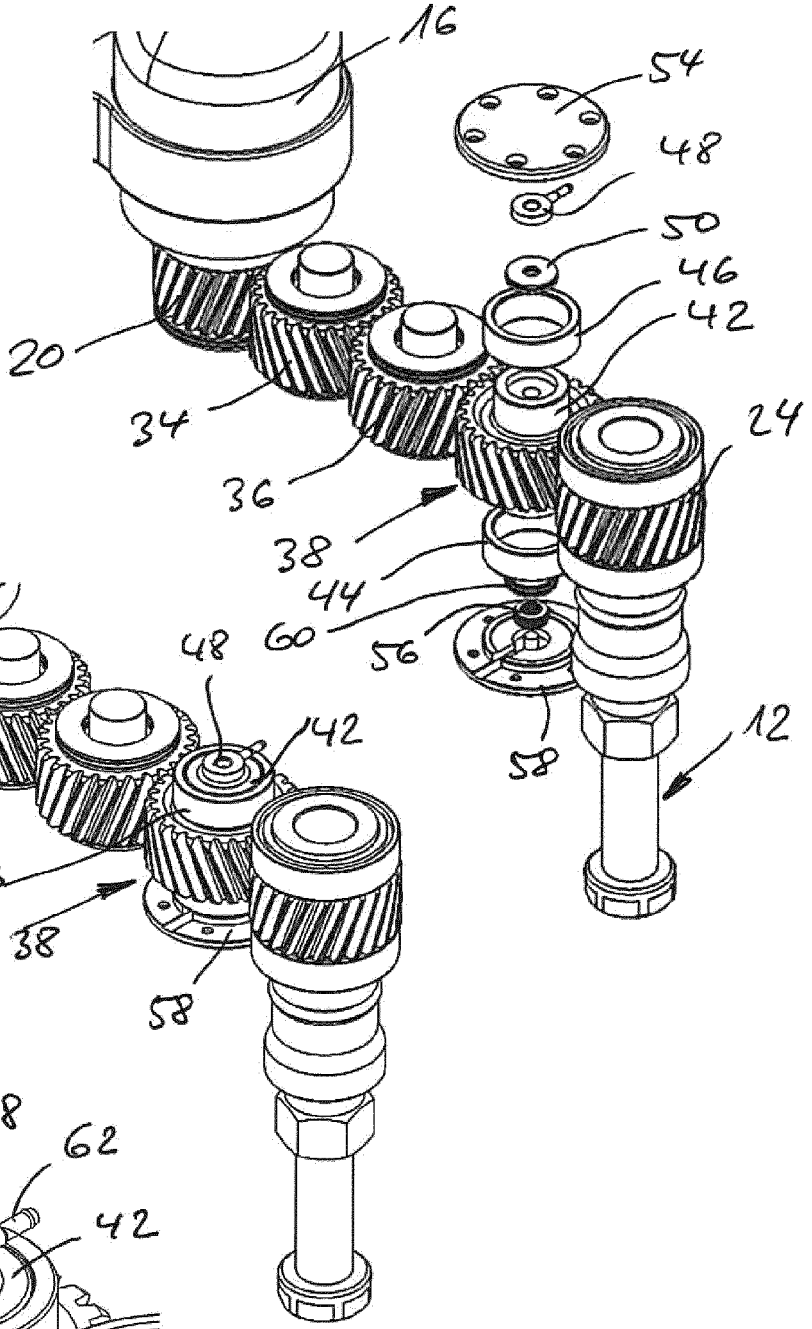
FIG. 5, FIG. 6 are perspective views of the assembly of gear wheels according to FIG. 2, FIG. 3, FIG. 5 showing an exploded view of the gear wheel which is used for the torque detection relative to the detecting means and FIG. 6 being a view in the assembled state.
Figure 6:
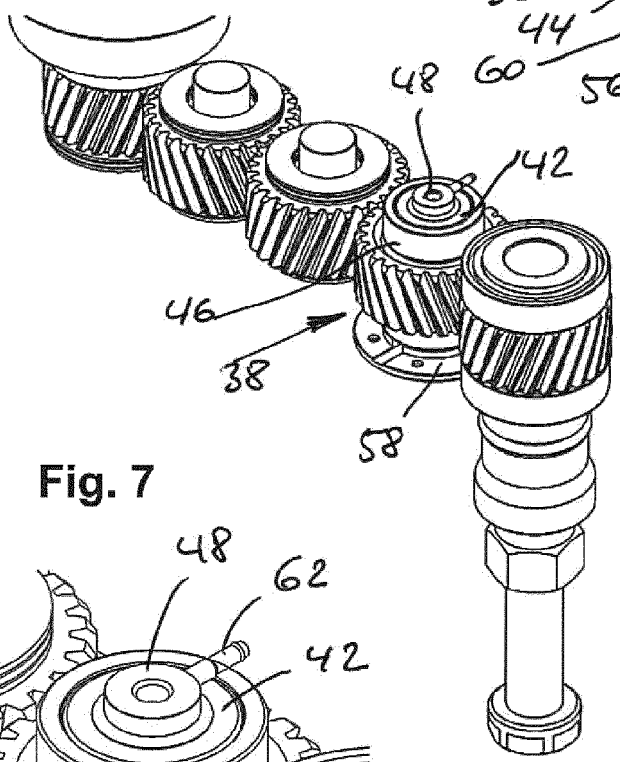
Figure 7:
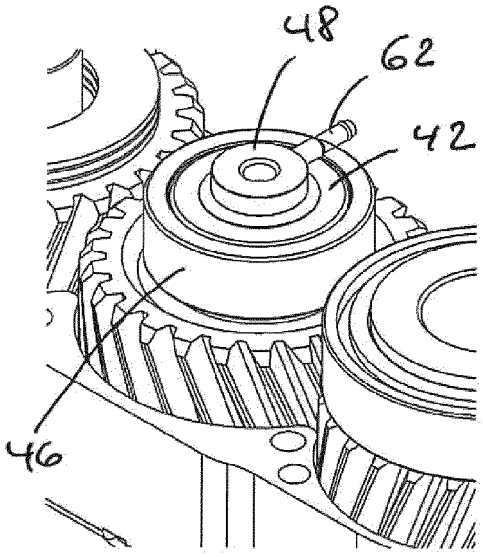

In particular the exploded perspective view of FIG. 5 shows the respective components in direct comparison to the assembled state (FIG. 6, FIG. 7, FIG. 8), the torque detection signal which is made available for a subsequent processing and evaluation in a manner known per se coming into contact with a cable connection 62 of force sensor 48. FIGS. 6 and 7 show the assembly when cover 54 is removed.

Field tests relating to a wide operating range (torque range) have shown that a force measurement signal (as signal voltage) generated by force sensor 48 is proportional to the torque being in contact with gear wheel 38 in an almost ideal manner (thus having an almost linear signal performance). Since gear wheel 38 meshes directly with the outer gearing of the output module (which applies the output torque directly to the screwing partner for the purpose of screwing) in the illustrated exemplary embodiment, the force sensor signal can represent the actual torque ratios on the output side at the flat output means in a very accurate, interference-free and reproducible manner in order to attain the object of the invention—the loss of the torque combination being negligible. Furthermore, this shows that it is realized without a significant increase in installation space or volume of flat output means 10 or of housing 30, 32, the present invention thus combining said advantages relating to the measurement with the best compactness and minimization of the requirements relating to the installation space.

The invention claimed is:

1. A screwing device for applying a torque to a screwing partner (12), the screwing device comprising flat output means (10) having an output which is detachably connectable to the screwing partner and a drive to which a driving torque can be applied manually or mechanically, via an interposed angular and/or bevel gearing (16), and comprising means (48) for detecting an output torque acting on the screwing partner at the output side, wherein the detecting means assigned to the flat output means and provided in particular on and/or in a housing (30, 32) of the flat output means are configured in such a manner that they detect an axial force acting on a helical gear wheel (38) which connects the drive and the output of the flat output means in a torque-transmitting manner, and can make said axial force available for signal evaluation.

2. The device according to claim 1, wherein the flat output means have the helical gear wheel (38) between a drive module (20), which has teeth and which forms the drive, and an output module (24), which has teeth and which forms the output, or wherein the helical gear wheel forms the output module.

3. The device according to claim 2, wherein a plurality of gear wheels (34, 36, 38) forming a gear assembly between the drive and the output are provided between the drive module and the output module.

4. The device according to claim 3, wherein the helical gear wheel meshes with the output module (24).

5. The device according to claim 1, wherein the helical gear wheel (38) is mounted to rotate about an axis of rotation (52) which extends at an angle of ≥45° to a longitudinal axis of the flat output means, the detecting means (48) detecting the axial force by the effect of a gear wheel shaft (40, 42) which forms the axis of rotation and/or at the edge of the teeth of the helical gear wheel.

6. The device according to claim 5, wherein the angle is 90°.

7. The device according to claim 1, wherein the detecting means are realized as pressure and/or force sensor means (48) which are assigned to the helical gear wheel (38) in a force-fitting manner.

8. The device according to claim 7, wherein the pressure and/or force sensor means are realized as a piezoelectric force sensor (48) or by strain gauges.

9. The device according to claim 7, wherein the pressure and/or force sensor means (48) are assigned to the helical gear wheel (38) in an axially adjacent manner.

10. The device according to claim 7, wherein the pressure and/or force sensor means (48) are supported on a housing side and/or flat side (30) of the flat output means.

11. The device according to claim 1, wherein the detecting means have means for signal transmission of a detection signal corresponding to the detected output torque.

12. The device according to claim 11, wherein the means for signal transmission are means for wireless signal transmission of the detection signal corresponding to the detected output torque.

13. The device according to claim 1, wherein the detecting means have hydraulic or pneumatic means which translate the axial force into a fluid pressure and which establish fluid communication with a fluid pressure sensor.

14. The device according to claim 13, wherein the hydraulic or pneumatic means are provided on or in a gear wheel shaft realizing the axis of rotation of the helical gear wheel.

15. The device according to claim 13, wherein the fluid pressure sensor is assigned to a housing of the flat output means.

16. The device according to claim 15, wherein the fluid pressure sensor is on or in said housing.

17. The device according to claim 1, wherein the detecting means have electronic interface means and/or signal processing means and electrical energy supply means.

18. The device according to claim 17, wherein the electrical energy supply means are realized as electric generator means interacting with a mobile, rotating, component of the flat output means.

19. Handheld screwing system having the screwing device according to claim 1, wherein and driving torque generating means (18) connected to the flat output means at the driving side.

20. The device according to claim 1, wherein said signal evaluation is electronic signal evaluation.

* * * * *